US011344143B2

(12) United States Patent
Wilson

(10) Patent No.: US 11,344,143 B2
(45) Date of Patent: May 31, 2022

(54) RETRACTABLE MAIL TRAY

(71) Applicant: John Wilson, LLC, Wilmer, AL (US)

(72) Inventor: John Wilson, Wilmer, AL (US)

( * ) Notice: Subject to any disclaimer, the term of this patent is extended or adjusted under 35 U.S.C. 154(b) by 0 days.

(21) Appl. No.: 16/952,216

(22) Filed: Nov. 19, 2020

(65) Prior Publication Data

US 2021/0251408 A1 Aug. 19, 2021

Related U.S. Application Data

(60) Provisional application No. 62/977,815, filed on Feb. 18, 2020.

(51) Int. Cl.
*A47G 29/12* (2006.01)

(52) U.S. Cl.
CPC ... *A47G 29/12097* (2017.08); *A47G 29/1209* (2013.01)

(58) Field of Classification Search
CPC ..... A47G 29/1209; A47G 29/12097; A47G 29/122; A47G 29/1223
USPC ..... 232/17, 29–33
See application file for complete search history.

(56) References Cited

U.S. PATENT DOCUMENTS 4,600,143 A * 7/1986 Harlow, Jr. ..... A47G 29/1216 232/17
D292,539 S * 10/1987 Harlow, Jr. ..... D99/29
4,714,192 A * 12/1987 Harlow, Jr. ..... A47G 29/1216 211/126.15
4,753,385 A * 6/1988 Phipps ..... A47G 29/1209 232/17
4,896,827 A * 1/1990 Economou ..... A47G 29/1209 232/17
5,009,366 A * 4/1991 van Druff, Jr. .... A47G 29/1209 232/17
5,765,749 A * 6/1998 Harper ..... A47G 29/12097 232/17
5,775,578 A * 7/1998 Baxi ..... A47G 29/12097 232/17
6,109,519 A * 8/2000 McClure ..... A47G 29/1216 232/17
D438,688 S * 3/2001 Rastetter ..... D99/29
D450,418 S * 11/2001 Belt ..... D99/29
6,698,651 B1 * 3/2004 Green ..... A47G 29/12097 232/29
7,000,826 B2 * 2/2006 Billings ..... A47G 29/12097 232/29
D531,379 S * 10/2006 Piner ..... D99/29
7,210,616 B1 * 5/2007 Van Watermulen ..... A47G 29/12097 232/29
7,451,912 B1 * 11/2008 Taube, II ..... A47G 29/1209 232/29
8,616,435 B2 * 12/2013 Crabtree ..... A47G 29/1209 232/29
D858,029 S * 8/2019 Jones ..... D99/43
(Continued)

*Primary Examiner* — William L Miller
(74) *Attorney, Agent, or Firm* — Brennan, Manna & Diamond, LLC

(57) ABSTRACT

This present application relates to a movable tray for use with a mailbox, as well as a kit, to allow an individual to retrofit a mailbox to accommodate the moveable tray of the present invention. The moveable tray of the present invention has a low coefficient of friction and may use a system of rails and channels to allow easy pulling of the moveable tray from the mailbox to retrieve the contents of the mailbox.

16 Claims, 2 Drawing Sheets

(56) References Cited

U.S. PATENT DOCUMENTS

| | | | | |
|---|---|---|---|---|
| 2002/0109005 | A1* | 8/2002 | Billings | A47G 29/12097 232/29 |
| 2005/0121503 | A1* | 6/2005 | Billings | A47G 29/12097 232/29 |
| 2005/0247770 | A1* | 11/2005 | Priest | A47G 29/12097 232/20 |
| 2005/0258227 | A1* | 11/2005 | Flores | A47G 29/1209 232/29 |
| 2013/0098979 | A1* | 4/2013 | Crabtree | A47G 29/1209 232/17 |
| 2021/0235912 | A1* | 8/2021 | McHenry | A47G 29/1209 |

* cited by examiner

RETRACTABLE MAIL TRAY

CROSS-REFERENCE TO RELATED APPLICATION

The present application claims priority to, and the benefit of, U.S. Provisional Application No. 62/977,815, which was filed on Feb. 18, 2020, and is incorporated herein by reference in its entirety.

BACKGROUND OF THE INVENTION

The present invention relates generally to the field of containers for receipt of packages, delivery items, courier materials and domestic mail. More specifically, the present invention relates to a mailbox having a retractable tray element that can be used to remove and retrieve contents deposited in the courier or mail box. In addition, the present application also includes a kit for retrofitting an existing mail or courier box to use the invention as provided herein. Accordingly, the present specification makes specific reference to the presently described invention. However, it is to be appreciated that aspects of the present invention are also useable with other like applications, devices and methods of manufacture.

Today, mail, packages and other items are placed within a mail or courier box for delivery to individuals or businesses. Typically, these items are deposited deep within the box to allow the box to be readily closed after delivery of the items. When attempting to reach inside the box from a car, golf cart, truck or other vehicle during retrieval, the vehicle causes some separation between the individual, making reaching into the confines of the box difficult—particularly when the items are at the rear of the box. In order to reach such deeply deposited items, the individual must exit the vehicle in a safe manner and reach into the box to then collect all of the deposited items. This can be inconvenient and potentially dangerous, particularly if the box is located on a busy street or if there has been inclement weather, such as snow or ice, which could cause the individual to lose his or her balance and fall on the slippery surface.

There is also a general need in the art to be able to retrofit or modify an existing mail or courier box to avoid having to purchase a new container, which may have a different solution to retrieve the contents, such as a second door that opens the rear of the box in order to be able to take the contents out from the other side of this box. However, this solution still requires an individual to approach the box outside of his or her vehicle and still exposes the individual to one or more of the risks identified above.

Therefore, there exists a long-felt need in the art for an improved solution for retrieving delivered items and post by individuals without the need to purchase an additional delivery box or container or expose oneself to other hazards when attempting to retrieve the mail, packages and other items from the mail or courier box. There is also a long felt need in the art for a retractable mail tray device that is relatively inexpensive to manufacture, and that is safe and easy to install and use.

In this manner, the improved mail or courier box solution of the present invention accomplishes all of the forgoing objectives. In addition, this new solution substantially departs from the concepts and designs of the conventional mail and courier boxes by providing an efficient and easy to use and install mail or delivered item retrieval device.

SUMMARY OF THE INVENTION

The following presents a simplified summary in order to provide a basic understanding of some aspects of the disclosed innovation. This summary is not an extensive overview, and it is not intended to identify key or critical elements or to delineate the scope thereof. Its sole purpose is to present some general concepts in a simplified form as a prelude to the more detailed description that is presented later.

The invention relates to a retractable or movable tray that is designed to work in combination with a mail or courier delivery box. The present disclosure also includes a kit of materials that one can purchase in order to implement the installation of the present solution. The device as contemplated herein includes a movable tray with a back stop and handle to facilitate movement of the tray and to prevent the mail or other delivered items from falling behind the tray, thereby circumventing the solution of the present invention.

In one exemplary embodiment of the presently described invention, a retractable tray for use with mail and courier boxes is provided; the tray has a top surface and a bottom surface, first and second longitudinally-extending sides, and first and second transversely-extending end edges. The first transversely-extending edge has a handle and the second transversely-extending edge has a back stop. The tray is sized and configured to fit within a mail or courier box, and the tray is slidable within the interior of the mail or courier box. The tray has a low coefficient of friction between itself and the sides of the mail or courier box, and for the static dry area, the pulling pressure ranges from between 0.1μ and 0.4μ.

In a still further exemplary embodiment of the present invention, a combination mail or courier box and movable tray, a mail or courier box sized and configured to receive delivered items is presented. The box has a base, sidewalls, a back wall and a door forming an interior area. A tray is included in the combination and has a top surface and a bottom surface, first and second longitudinally-extending sides, and first and second transversely-extending end edges. The first transversely-extending edge has a handle and the second transversely-extending edge has a back stop. The tray is sized and configured to fit within a mail or courier box, and to be slidable within the interior area of the box.

In a yet still further exemplary embodiment of the present invention, a kit for retrofitting a mailbox is presented and includes a package containing elements of the kit. At least one strip of material is provided, with the strip of material having a base with adhesive on one side of the base and a rail extending upwardly from the base on a second side of the base. A configurable tray is included in the kit, with the tray having first and second ends and first and second sides. On the first end is a handle, and on the second end is a backing plate extending upward from the tray. The tray has first and second surfaces, with the second surface having at least one channel or strip sized and configured to fit a corresponding rail or strip on the base.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
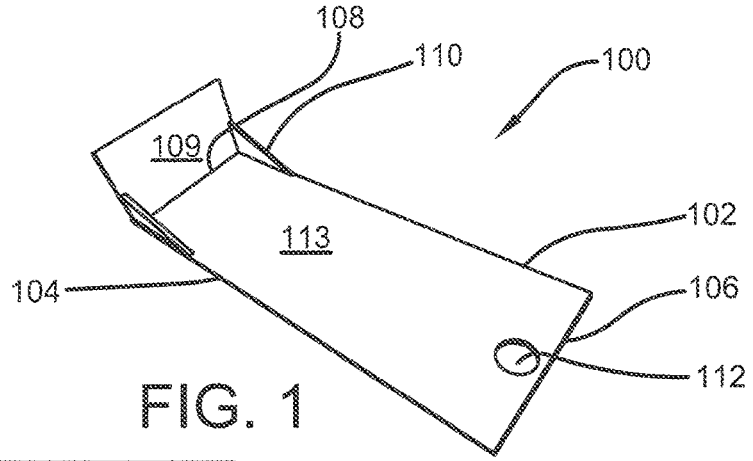
FIG. 1 illustrates a perspective view of one potential embodiment of the retractable mail tray of the present invention in accordance with the disclosed architecture and depicting the tray, a back stop and a handle.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention or do not limit the scope of the invention. Additionally, an illustrated embodiment need not have all the aspects or advantages shown. Thus, in other embodiments, any of the features described herein from different embodiments may be combined.

As previously stated, there is a long-felt need in the art for an improved solution for retrieving delivered items and post by individuals without the need to purchase an additional delivery box or container or expose oneself to other hazards when attempting to retrieve the mail, packages and other items from the mail or courier box. There is also a long felt need in the art for a retractable mail tray device that is relatively inexpensive to manufacture, and that is safe and easy to install and use.

The present invention, in one exemplary embodiment, includes a movable or repositionable tray for use with mail and courier boxes to allow individuals to remove the delivered items from the confines of the box without the inconvenience of having to exit their vehicle or expose themselves to traffic and/or other conditions which may be unsafe. In addition, the present application also provides for a kit to allow an individual to retrofit their mail or courier box without having to seek an alternate solution in order to facilitate the removal of the contents of the mail or courier box.

There are a number of standards which a mailbox intended to receive U.S. post must meet. These include a height of between 41 and 45 inches as measured from the bottom of the mailbox to the top of the road surface. This height requirement is to allow the US Postal Service (USPS) employee or courier to be able to place mail or packages in the mailbox without having to leave the delivery vehicle. The door of the mailbox must be 6-8 inches from the edge of the street or curb, where curbs are provided when the door is closed. This is to ensure that the mailbox is out of the way of traffic present in the roadway, but also contributes to the problem when mail is placed in the mailbox, as the starting point for collecting and withdrawing the mail is now 6 to 8 inches from the side of the road. When added to the width of the door of the individual's vehicle, the distance increases by several times, making grasping the mail and other contents more difficult.

The mailbox must face outward and be placed on the right-hand side of the road. The minimum interior dimensions of a mailbox are 19.38L×7W×9H inches. Larger mailboxes are of course available and depend on the preferences of the user. For example, which the standard mailbox configuration has a rounded top and is generally rectangular in size, individuals can install square and various fanciful mailboxes to illustrate their individual tastes or to match, for example, the exterior of their home or appearance of their neighborhood.

Mailboxes are typically made from galvanized steel, so that they do not rust or corrode due to exposure to weather, and have a flag that can be raised in order to indicate that there is outgoing mail in the box to be picked up by the USPS carrier. In addition, the door must have a latch in order to secure the contents once delivered to the individual address. The latch may be magnetic or have an engaging mechanical element so that the door remains closed.

Referring now to the drawings, FIG. 1 illustrates a perspective view of one potential embodiment of the retractable mail tray 100 of the present invention in accordance with the disclosed architecture. Movable tray 100 may be made from polyethylene, polypropylene, polystyrene, nylon, tetratluoroethylene and composites thereof. The particular materials used in the manufacture of the tray provide for a low coefficient of friction between the steel of the mail box and the static dry area, the pulling pressure ranges from between 0.1μ and 0.4μ. The tray 100 has first and second longitudinally-extending sides 102 and 104 and first and second transversely-extending end edges 106 and 108.

FIG. 1 also shows the backstop 109, which extends upwardly from the top surface 113 of the tray 100. The backstop 109 is shown as extending upwardly at about 90° from the surface. The backstop 109 can be provided at an angle ranging from 45° to 90°. By providing an angled or upright backstop 109, mail and other delivered items are prevented from falling behind the back stop. Backstop 109 may also be provided with angled edge braces 110 on each side of the backstop 109, which will help corral the mail and other delivered items and keep them in position on the tray 100 and against the backstop 109 as the tray is pulled forward. The first transversely-extending edge 106 is provided with a handle 112, which enables a user to grasp the tray 100 and pull the tray forward out of the mailbox. The handle 112 may be of any configuration and may have a hand hold to facilitate grasping of the tray.

Figure 2:
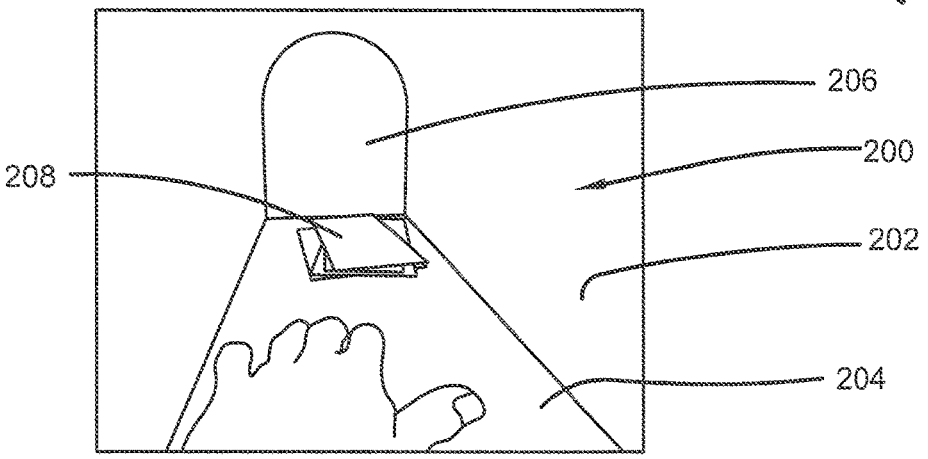
FIG. 2 illustrates a perspective view of one potential embodiment of the type of mailbox with which the retractable mail tray of the present invention may be used in accordance with the disclosed architecture.

Reference is now directed to FIG. 2, which illustrates a perspective view of one potential embodiment of a mailbox in which the retractable mail tray of the present invention may be used in accordance with the disclosed architecture. More specifically, FIG. 2 illustrates the interior 200 of a mailbox having sidewalls 202, base 204 and a back wall 206. Inside of the mailbox interior 200 shows a collection of mail 208, or other items that have been delivered by the USPS personnel.

Figure 3:
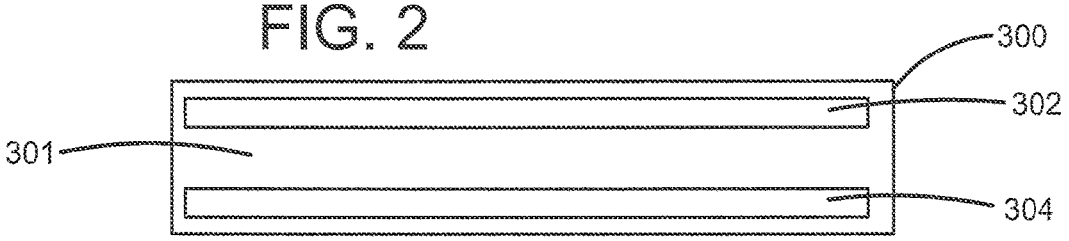
FIG. 3 illustrates a bottom perspective view of one potential embodiment of the retractable mail tray of the present invention in accordance with the disclosed architecture and having channels or rails positioned thereon.

FIG. 3 illustrates a bottom perspective view of one potential embodiment of the retractable mail tray 300 of the present invention in accordance with the disclosed architecture and having channels or rails positioned thereon. More specifically, the mail tray 300 comprises a bottom surface 301, and first and second strips or channels 302 and 304. The strips or channels 302 and 304, depending on the configuration, may either provide an easy glide material—such as tetrafluoroethylene—or may be configured as channels so that the tray 300 will ride on a series of rails as shown and described in a later figure. If elements 302 and 304 are channels, then the rails are provided on the base of the mailbox. While two strips or channels are shown in FIG. 3, it should be understood that only one rail or strip may be used or any number of rails or strips could be applied as needed. The channels, rails and/or strips would preferably be of a length between 16 and 19 inches so that the tray can be fully contained in the mailbox and easily moved forward a distance to allow the user to grasp the contents on the tray.

Figure 4:
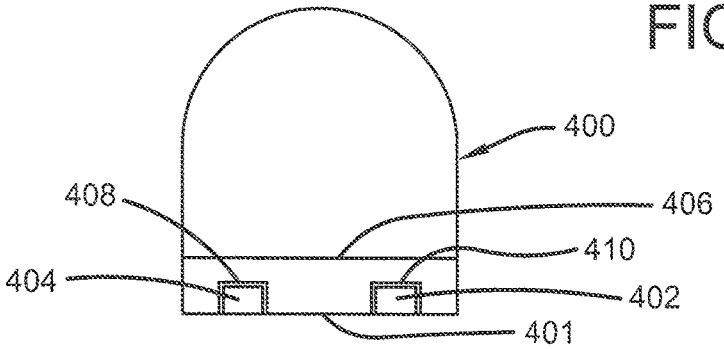
FIG. 4 illustrates a front perspective view of one potential embodiment of the retractable mail tray of the present invention in accordance with the disclosed architecture and showing the rails or strips of material placed inside the mail box to facilitate movement of the tray therein.

FIG. 4 illustrates a front perspective view of one potential embodiment of the retractable mail tray 406 of the present invention in accordance with the disclosed architecture and positioned within a mailbox 400. More specifically, the mailbox 400 is comprised of a base 401 with first and second rails, or strip 402 and 404 provided on the base 401. The tray 406 is shown on top of the rails 402 and 404, and the rails 402, 404 are engaged with channels or complimentary strips 408 and 410. This allows for ease of sliding of the tray 406 with respect to the interior of the mailbox 400.

Figure 5:
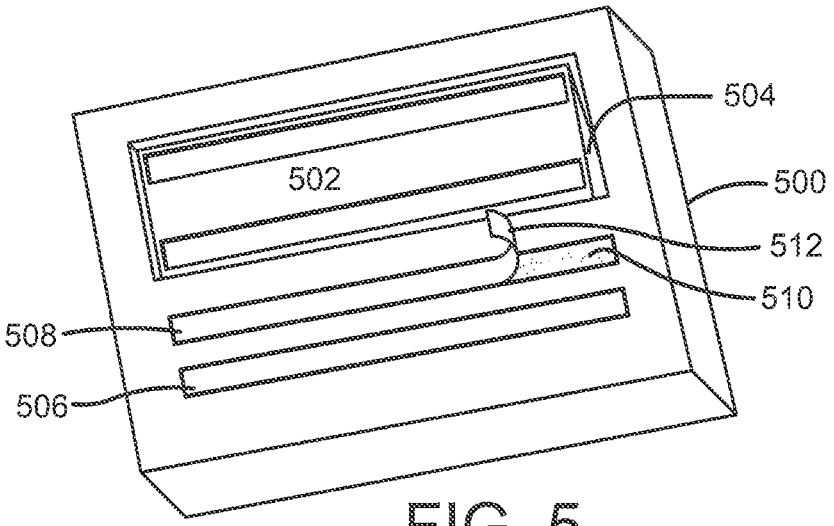
FIG. 5 illustrates a perspective view of one potential embodiment of a retractable mail tray kit of the present invention in accordance with the disclosed architecture, wherein the kit may be used to retrofit an existing mailbox with the retractable mail tray of the present invention.

FIG. 5 illustrates a perspective view of one potential embodiment of a retractable mail tray kit 500 of the present invention in accordance with the disclosed architecture, wherein the kit 500 may be used to retrofit an existing mailbox with the retractable mail tray of the present invention. More specifically, the kit 500 is generally a box or other consumer retail package that comprises a retractable mail tray 502 having a backstop 504 and first and second strips or channels 506 and 508, respectively. The strip 508 is shown with adhesive 510 and the release layer 512, which is peeled back to reveal the adhesive. The adhesive is generally a permanent adhesive to secure the strips to the base of the mailbox. In use, the strips 506 and 508 are removed, and the release layer or liner 512 is peeled off and the strips are placed parallel to the longitudinal sides of the mailbox sidewalls. Then the tray 502 is positioned over the strips or rails with the backstop 504 toward the rear of the mailbox interior and against the back wall of the mailbox. The kit of this embodiment may be sold in any hardware, home improvement or other store or retail outlet where mailboxes are sold. In addition, the kits may be purchased on-line from e-retailers or other private sellers, such as on ETSY.

Figure 6:
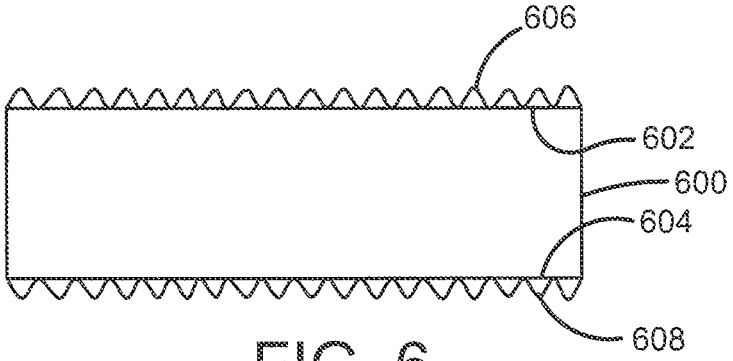
FIG. 6 illustrates a perspective view of one potential embodiment of a retractable mail tray of the present invention in accordance with the disclosed architecture, and having a brush, fabric or other strips applied to the sides of the mail tray to create a seal between the mail tray and the interior walls of the mail or courier box.

Reference is now directed to FIG. 6, which illustrates a perspective view of one potential embodiment of a retractable mail tray 600 of the present invention in accordance with the disclosed architecture. More specifically, the tray 600 is comprised of opposing longitudinal sides 602 and 604 having strips of material 606 and 608 disposed along the length of such sides, respectively. The strips of materials 606, 608 may include rubber strips, brushes, fabric strips, strips of tetrafluoroethylene or combinations thereof, and are generally provided to prevent mail and other items from slipping off the edges of the tray 600 and becoming inaccessible to the individual. In addition, the strips of material 606, 608 may also enhance the sliding and removal of the retractable tray 600 from the interior of the mailbox.

Figure 7:
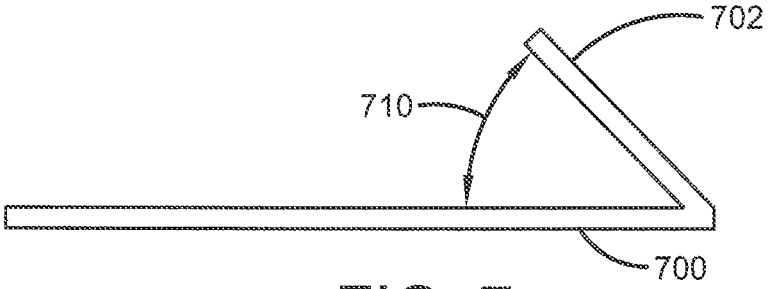
FIG. 7 illustrates a side perspective view of one potential embodiment of a retractable mail tray of the present invention in accordance with the disclosed architecture and having a back stop provided at an angle to catch mail or other delivered items inserted into the mail or courier box.

FIG. 7 illustrates a side perspective view of one potential embodiment of a retractable mail tray 700 of the present invention in accordance with the disclosed architecture and having a back stop 702 provided at an angle to catch mail or other delivered items inserted into the mail or courier box. More specifically, the backstop 702 is positioned at an angle 710 of between 45 and 90 degrees and as shown in the figure, is angled at roughly 45 degrees. By providing a back stop 702 in either a vertical or angled position, the backstop 702 then is able to hold and collect the mail from falling behind the tray 700. The backstop may also be provided with strips of material on the sides (e.g., a rubber strip, brush, fabric strip, strip of tetrafluoroethylene, or the like), as with the sides of the tray as shown in FIG. 6, such that the backstop further serves to sweep the inserted contents of the mailbox from the interior of the mailbox.

Certain terms are used throughout the following description and claims to refer to particular features or components. As one skilled in the art will appreciate, different persons may refer to the same feature or component by different names. This document does not intend to distinguish between components or features that differ in name, but not structure or function. As used herein, "strips," "channels," and "rails" are interchangeable and refer to improved movable trays for use with a mailbox of the present invention.

Notwithstanding any of the forgoing, the retractable and movable mail tray of the present invention and its various components can be of any suitable size and configuration as is known in the art without affecting the overall concept of the invention, provided that they accomplish the above stated objectives. One of ordinary skill in the art will appreciate that the size, configuration and material of the retractable and movable mail tray and its various components as shown in the FIGS. are for illustrative purposes only, and that many other sizes of the retractable and movable mail tray are well within the scope of the present disclosure. Although the dimensions of the retractable and movable mail tray and its various components are important design parameters for user convenience, the retractable and movable mail tray and its various components may be of any size that ensures optimal performance during use and/or that suits user need and/or preference.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations that fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A retractable tray for use with a mailbox and comprising:

a tray having a top surface and a bottom surface, first and second longitudinally extending sides, a first transversely extending end edge, and a second transversely extending end edge, wherein the first transversely extending end edge is comprised of a handle and the second transversely extending end edge is comprised of a back stop;

the tray is sized and configured to fit within the mailbox, and the tray being slidable within an interior of the mailbox; and the tray having a low coefficient of friction between the tray and each of a first interior side of the mailbox and a second interior side of the mailbox, wherein each of the first and second longitudinally extending sides has one of a rubber strip, a brush, a fabric strip, and a strip of tetrafluoroethylene to form a seal between the tray and the first and second interior side of the mailbox.

2. The retractable tray as recited in claim 1, wherein the back stop of the tray extends upwardly from the top surface of the tray at a 90° angle relative to the top surface of the tray.

3. The retractable tray as recited in claim 1, wherein the back stop extends upwardly from the top surface of the tray at an angle of between 45° and 90° relative to the top surface and in a direction of the handle.

4. The retractable tray as recited in claim 1, wherein the coefficient of friction for a static dry area ranges from between 0.1p and 0.4p.

5. The retractable tray as recited in claim 1, wherein the handle includes a finger grip.

6. The retractable tray as recited in claim 1, wherein the tray is made from one of a polyethylene, a polypropylene, a polystyrene, a nylon, and a tetrafluoroethylene.

7. The retractable tray as recited in claim 1, wherein the bottom surface of the tray comprises at least one strip of tetrafluoroethyiene.

8. The retractable tray as recited in claim 1, wherein the bottom surface of the tray comprises one or more rails or channels.

9. A combination mailbox and movable tray comprising:

a mailbox sized and configured to receive a delivered item, the mailbox comprised of a base, a pair of sidewalls, a back wall, and a door forming an interior area; and a tray comprised of a top surface and a bottom surface, a first and a second longitudinally extending side, and a first and a second transversely extending end edge, wherein the first transversely extending end edge is comprised of a handle and the second transversely extending end edge is comprised of a back stop, and further wherein the tray is sized and configured to fit within the mailbox and is repositionable in and partially out of the interior area, and further wherein each of the first and second longitudinally extending sides has one of a rubber strip, a brush, or a fabric strip to form a seal between the tray and each of the pair of sidewalls of the mailbox.

10. The combination mailbox and movable tray as recited in claim 9, wherein the back stop extends upwardly from the top surface at an angle of between 45° and 90° relative to the top surface and in a direction of the door.

11. The combination mailbox and movable tray as recited in claim 9, wherein the tray is made from one of a polyethylene, a polypropylene, a polystyrene, a nylon, and a tetrafluoroethylene.

12. A kit for retrofitting a mailbox comprising:

a package containing a collection of elements forming the kit, wherein the kit is comprised of:

at least one strip of material, wherein the at least one strip of material is comprised of a base with an adhesive on a first side of the base, and a rail extending outwardly from the base on a second side of the base; and a configurable tray comprised of a handle, a first end, a second end, a first surface, a second surface, a backing plate, a first side, and a second side, wherein the handle is positioned on the first end and the backing plate is positioned on the second end, and further wherein the second surface is comprised of at least one channel sized and configured to fit the rail on the base.

13. The kit for retrofitting a mailbox as recited in claim 12 comprising at least two strips of material, wherein each of the at least two strips of material have an adhesive on the first side of the base, and one of a strip of tetrafluoroethylene or the rail extending outwardly from the second side of the base.

14. The kit for retrofitting a mailbox as recited in claim 12, wherein each of the first and second sides of the configurable tray are comprised of one of a rubber strip, a brush, a fabric strip, or a strip of tetrafluoroethylene.

15. The kit for retrofitting a mailbox as recited in claim 12, wherein the backing plate has first and second sides with each of the sides having one of a rubber strip, a brush, a fabric strip, or a strip of tetrafluoroethylene.

16. The kit for retrofitting a mailbox as recited in claim 12, wherein the backing plate extends upwardly from the first surface at an angle of between 45° and 90° relative to the first surface and in a direction of a door of the mailbox.

* * * * *